US012599953B2

(12) United States Patent
Wagner, Jr. et al.

(10) Patent No.: US 12,599,953 B2
(45) Date of Patent: Apr. 14, 2026

(54) METHOD FOR FORMING AND HEAT TREATING NEAR NET SHAPE COMPLEX STRUCTURES FROM SHEET METAL

(71) Applicant: Spirit AeroSystems, Inc., Wichita, KS (US)

(72) Inventors: James Michael Wagner, Jr., Wichita, KS (US); Theodore Joseph Eilert, Wichita, KS (US); Rahbar Nasserrafi, Andover, KS (US); Craig Matthew Clasper, Derby, KS (US); Gerald Eugene Hicks, Jr., Wichita, KS (US)

(73) Assignee: Spirit AeroSystems, Inc., Wichita, KS (US)

( * ) Notice: Subject to any disclaimer, the term of this patent is extended or adjusted under 35 U.S.C. 154(b) by 570 days.

(21) Appl. No.: 17/682,878

(22) Filed: Feb. 28, 2022

(65) Prior Publication Data

US 2023/0271242 A1 Aug. 31, 2023

(51) Int. Cl.
*B21D 37/16* (2006.01)
*B21D 22/02* (2006.01)
(Continued)

(52) U.S. Cl.
CPC ..... *B21D 37/16* (2013.01); *B21D 22/022* (2013.01); *C21D 1/673* (2013.01); *C21D 9/46* (2013.01)

(58) Field of Classification Search
CPC .... B21D 22/022; B21D 22/208; B21D 37/16; C21D 9/46; C21D 1/673
(Continued)

(56) References Cited

U.S. PATENT DOCUMENTS 3,053,969 A * 9/1962 Kerr ..... B23K 1/0014 219/85.17
3,071,853 A * 1/1963 Price ..... B21D 47/00 228/221
(Continued)

FOREIGN PATENT DOCUMENTS

| | | |
|---|---|---|
| CN | 109201838 | 1/2019 |
| CN | 113351725 | 1/2021 |
| DE | 4307563 | 9/1994 |

OTHER PUBLICATIONS

CN 113046528A, Chen et al. Jun. 2021.*
Partial European Search Report in related EP Application23157125.8 dated Jul. 21, 2023, 31 pages.

*Primary Examiner* — Edward T Tolan
(74) *Attorney, Agent, or Firm* — Stinson LLP

(57) ABSTRACT

A method of manufacturing a complex-shaped metal part, including the steps of applying a metallic sheath around a sheet metal workpiece and applying an electric current through the workpiece in the metallic sheath to heat the workpiece. The method also includes shaping the workpiece in the metallic sheath into a complex-shaped metal part while it is being heated. The shaping can be performed between two ceramic dies or using other techniques for forming complex shapes and curvatures into the workpiece. The method then may include cooling the complex-shaped metal part and removing the metallic sheath from the complex-shaped metal part. This method can allow reactive and refractory material to be safely heated without oxidation when heating/forming in air when the workpiece is sealed within a sacrificial stainless steel or nickel alloy envelope to protect the enclosed workpiece.

16 Claims, 9 Drawing Sheets

(51) Int. Cl.
*C21D 1/673* (2006.01)
*C21D 9/46* (2006.01)

(58) Field of Classification Search
USPC ..... 72/342.96
See application file for complete search history.

(56) References Cited

U.S. PATENT DOCUMENTS 3,737,978 A * 6/1973 Rathbun ..... B23K 1/0014 228/221
3,823,303 A * 7/1974 Manchester ..... B21D 22/02 219/153
4,087,037 A * 5/1978 Schier ..... B21D 26/055 72/63
4,559,797 A * 12/1985 Raymond ..... B21D 26/055 72/63
4,584,860 A * 4/1986 Leonard ..... B21D 26/055 72/364
4,644,626 A * 2/1987 Barnes ..... B21D 25/02 72/63
4,706,361 A * 11/1987 Meyer ..... B21D 26/055 228/265
4,984,348 A * 1/1991 Cadwell ..... B21D 26/055 72/38
5,118,026 A * 6/1992 Stacher ..... B21D 26/055 228/262.71
5,144,825 A * 9/1992 Burg ..... B21D 26/055 29/889.7
6,202,277 B1 * 3/2001 Zahedi ..... B23K 20/02 264/316
6,564,604 B2 5/2003 Kefferstein et al.
7,068,268 B2 * 6/2006 Kubota ..... G06T 19/20 700/98
7,431,196 B2 * 10/2008 Eilert ..... B29C 51/10 228/181
8,652,276 B2 * 2/2014 Nasserrafi ..... C22F 1/18 72/342.96
8,653,399 B2 * 2/2014 Seid ..... H05B 3/0004 219/161
8,782,887 B2 7/2014 Franchet et al.
9,889,813 B2 * 2/2018 Evans ..... B23K 20/106
2001/0042393 A1 11/2001 Kefferstein et al.
2009/0152256 A1 * 6/2009 Seid ..... C21D 7/13 72/364
2013/0008027 A1 1/2013 Franchet et al.
2014/0251531 A1 * 9/2014 Chergui ..... B32B 15/08 156/443

* cited by examiner

METHOD FOR FORMING AND HEAT TREATING NEAR NET SHAPE COMPLEX STRUCTURES FROM SHEET METAL

BACKGROUND

Metal alloy structures and various carbon composite parts are often used in the aircraft industry for structural aircraft parts. However, conventional and advanced materials used for aerospace, propulsion and hypersonic applications have various shortcomings.

Hot forming of high-performance alloys is one method used to shape metal alloy structures. In order to form complex shapes, the work piece or metal alloy is often heated in a furnace and formed in heated dies under pressure. Alternatively, super plastic forming (SPF) allows using inert gas pressure differential to form a heated metal workpiece into complex shapes inside a metallic or ceramic die.

Both hot forming and SPF typically employ indirectly heated dies and heated sheet metal to facilitate forming. Since both the die and part/workpiece need to be heated prior/during forming, these conventional processes are slow as the mass of the die is typically several times of the mass for the sheet metal and will consume large amounts of energy and take a long time to reach the desired forming temperature. In addition, hot forming and SPF typically result in some degree of localized thinning within the part. Furthermore, the high temperatures traditionally required for such forming can later require heat treatment after the forming thereof. For example, typically parts hot formed or super plastically formed require re-heat treatment to restore their mechanical properties. Unfortunately, the thin-walled configuration often deforms after heat treatment, which increases rework and can at times result in scrapping of some parts. Additional testing is also often required to certify heat treatment, which adds to the cost of the part, especially for fatigue or damage tolerant applications.

Thus, the technology described herein addresses current shortcoming of forming and treating techniques used for metal alloy parts.

SUMMARY

The present invention solves the above-described problems and provides a distinct advance in the art of manufacturing metal parts. Specifically, Applicant discovered that applying electric current directly into a vacuum sealed metallic envelope containing high performance aerospace sheet metals under inert atmosphere or protected environment while forming the sheet metal into complex configurations in accordance with methods herein may result in minimized cycle times and reduced localized thinning of the resulting part. Furthermore, some methods herein may also allow the metal to flow or be drawn into a mold cavity at least partially before being stretched and formed into its final shape.

Embodiments of the present invention may include a method of manufacturing complex-shaped metal parts and may comprise a step of applying a metallic sheath to encapsulate a metal workpiece in a vacuum sealed envelope. The metal workpiece may be high performance aerospace sheet metal and/or may comprise one or more of the following: reactive alloys, cobalt base alloys, nickel base alloys, various steels, titanium alloys, niobium base alloy sheets, tungsten base alloy sheets, molybdenum base alloy sheets, hafnium base alloy sheets, and rhenium base alloy sheets. In some embodiments, the metallic sheath may include a port for purging with an inert gas followed by evacuation to remove air and gasses then sealing it from the atmosphere. The metallic sheath and the workpiece therein may be heated by electric current being applied therethrough, and pressure may be applied by one or more dies to the workpiece and metallic sheath, thereby forming the workpiece into a desired complex shape or complex curvature. Forming may also be followed by cooling of the resulting part under pressure.

In accordance with one embodiment, a method of manufacturing a complex-shaped metal part may include the steps of applying a metallic sheath around a workpiece that is made of metal, applying an electric current through the workpiece in the metallic sheath to heat the workpiece, and shaping the workpiece in the metallic sheath into a complex-shaped metal part. Furthermore, the method may include cooling the complex-shaped metal part.

In accordance with another embodiment, a method of manufacturing a complex-shaped metal part may include a step of enclosing a worksheet within a metallic sheath. The workpiece may be sheet metal made of at least one of a refractory allow and a reactive alloy, and the metallic sheath may be a sacrificial metal. The method may also include a step of evacuating atmosphere through an opening in the metallic sheath via vacuum and sealing the opening of the metallic sheath following the evacuating step. Furthermore, the method may include a step of applying an electric current through the workpiece in the metallic sheath to heat the workpiece and shaping the workpiece in the metallic sheath into a complex-shaped metal part, including pressing the workpiece in the metallic sheath against at least one ceramic tooling surface. Furthermore, the method may include cooling the complex-shaped metal part.

In yet another embodiment, a system for manufacturing a complex-shaped metal part may include at least one ceramic tooling having a ceramic tooling surface shaped with one or more complex curvatures, as well as at least two electrical contacts or leads for applying electrical current through a metallic sheath and a workpiece vacuum sealed within the metallic sheath. The system may also include workpiece tension control components located at opposing ends of the ceramic tooling surface and actuatable in opposite directions to enable draping of the metallic sheath and the workpiece vacuum sealed therein toward the ceramic tooling surface while the two electrical contacts or leads apply electrical current therethrough.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in more detail below with reference to the attached drawing figures, wherein:

FIG. 1*a* is a side cross-sectional view of a metal workpiece enclosed within a metallic sheath, in accordance with embodiments of the present invention;

FIG. 1*b* is a top cross-sectional view of the metal workpiece enclosed within the metallic sheath of FIG. 1*a*, in accordance with embodiments of the present invention;

Figure 8:
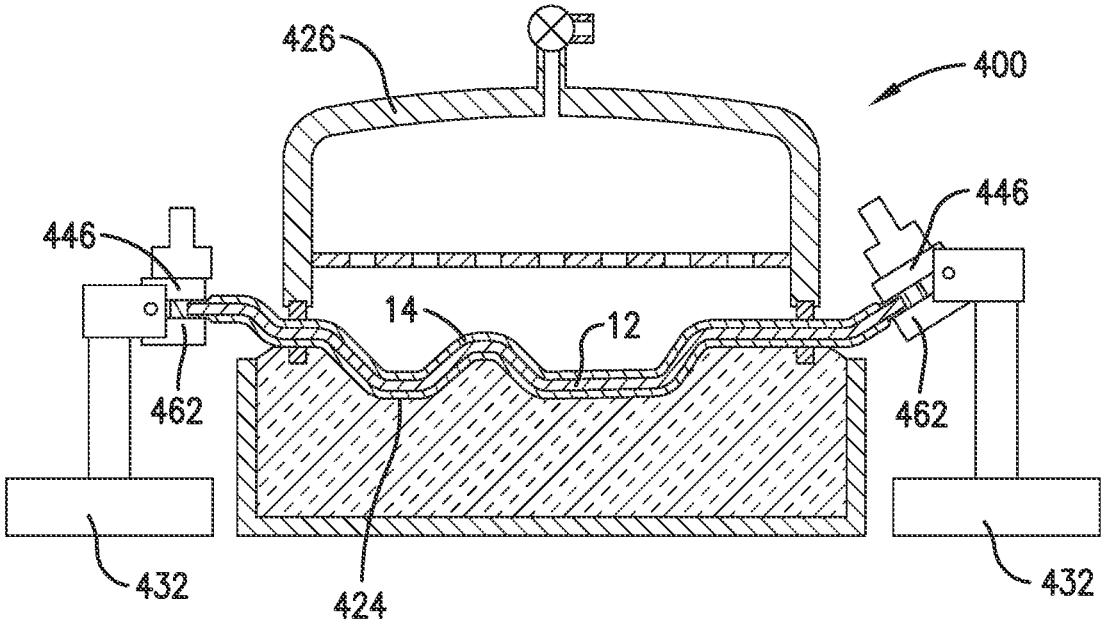
FIG. 8 is a side cross-sectional view of yet another alternative system for shaping the metal workpiece including individually adjustable clamps, in accordance with embodiments of the present invention.
Figure 9A:
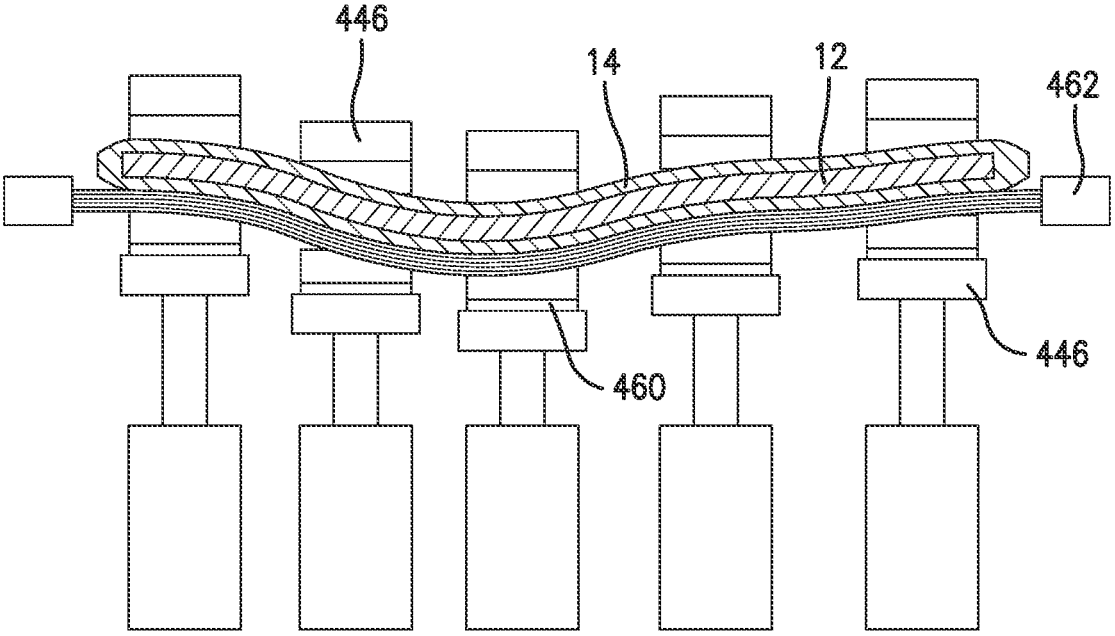
Figure 9B:
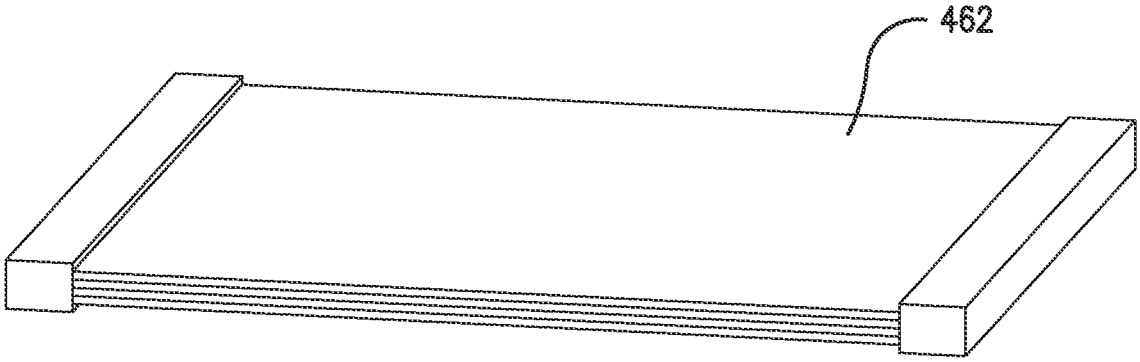
Figure 10:
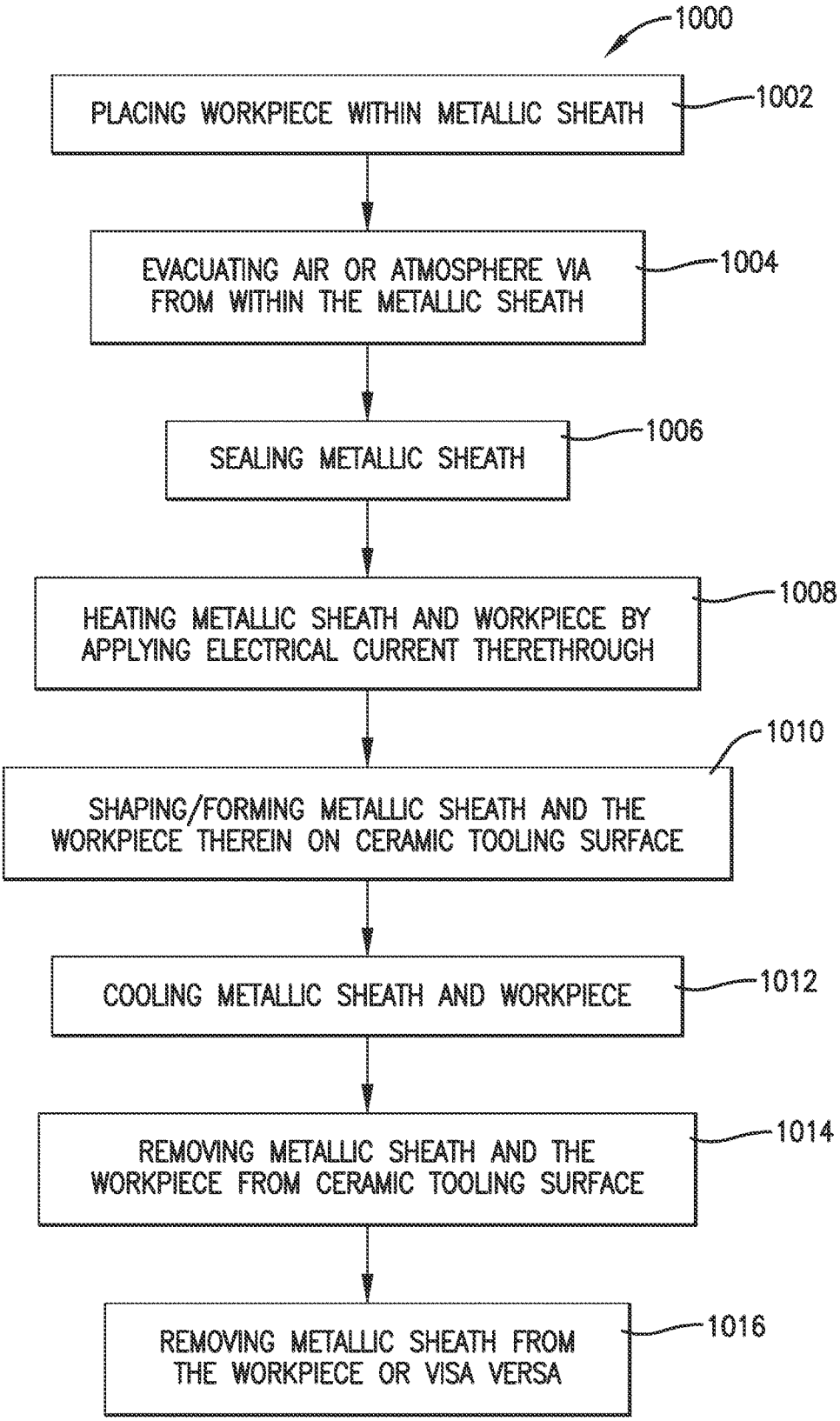

FIG. 9*a* is an alternative side cross-sectional view of the clamps of FIG. 8 with flexible copper leads sandwiched in the clamps, in accordance with embodiments of the present invention;

FIG. 9*b* is a side cross-sectional view of the flexible copper leads of FIG. 9*a*, in accordance with embodiments of the present invention; and FIG. 10 is a flow chart of a method for manufacturing a complex-shaped metal part in accordance with embodiments of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

The present invention solves the above-described problems and provides a distinct advance in the art of manufacturing refractory and high-temperature sheet metal parts. In some embodiments, to address various disadvantages in regard to cycle times, localized thinning, and re-heat treatment in prior art methods of shaping sheet metal workpieces into complex-shaped parts, the present invention provides an improved method for manufacturing such complex-shaped parts for use on aircrafts and various aerospace structures. Specifically, applicant discovered that applying pulsed or continuous electrical direct current or alternative current directly into a vacuum sealed metallic envelope (e.g., metallic sheath) containing high performance aerospace sheet metal under inert atmosphere or protected environment while forming the sheet metal into complex configurations in accordance with methods herein may result in minimized cycle times and reduced localized thinning of the resulting part. Furthermore, the material used to envelop and protect the workpiece may allow the workpiece to be resistance heated without detrimental oxidation or reaction with the environment while being formed into complex shapes.

Generally, systems and methods for manufacturing complex-shaped metal parts are disclosed herein for various uses, such as metal aircraft components, structures, or the like. The workpiece may be encased by encapsulation into a vacuum sealed envelope (also referred to herein as a metallic sheath) made of sacrificial metallic cover sheets or sacrificial metallic plates which may be sealed via welding. The workpiece encased in the metallic sheath may be subsequently heated by application of an electric current and then pressed into desired shapes using ceramic dies or other shaping techniques known in the art. Upon completion of forming/shaping, the resulting formed part may be trimmed, and the sacrificial cover/metallic sheath may be removed. The formed part, as described herein, may be a complex-shaped metal part or a formed metal part having simple shapes or curvatures formed therein. Following removal of the formed part from the metallic sheath, the formed part may be inspected and processed further (e.g., holes drilled), machined, coated with thermal barrier coating, and/or assembled into a desired structure. The formed part may or may not require additional heat treating, as later described herein.

Advantageously, the workpiece is directly heated by passage of electricity therethrough, and thus principles of electro-plasticity can be used to eliminate work hardening and reduce flow stresses. Furthermore, forming can be initiated at appreciably lower temperatures via passing an electrical pulse through the refractory or high-temperature sheet metal (also referred to herein as a "workpiece"). Such forming at temperatures below the aging temperature of the workpiece can advantageously eliminate the need for heat treatment after forming operation. In some embodiments, forming can be performed at temperatures slightly below (e.g., 25 degrees F.-75 degrees F. below) the precipitation hardening temperature for the workpiece or sheet metal/alloy, such that the resulting formed part may no longer require re-heat treatment, and the certificate of compliance from the mill supplying the sheet metal will still be applicable to the formed part. In addition to eliminating the need for recertification of the raw material as it converts into a complex-shaped part, methods described herein can advantageously reduce production steps, production lead time, and the costs for fabricating the finished part.

Figure 1A:
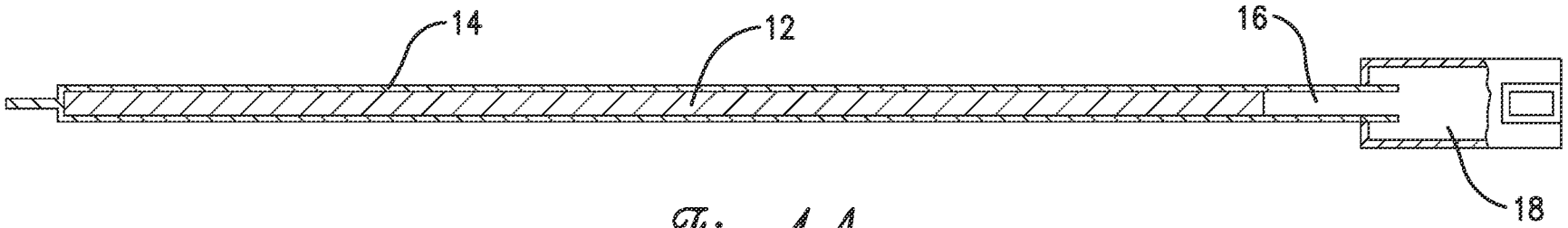

FIGS. 1*a*-9*b* disclose various components and tooling of a system 10 for manufacturing a formed part in accordance with embodiments herein. FIGS. 1*a* and 1*b* depict a workpiece 12 surrounded by a metallic sheath 14 forming a chamber around the workpiece 12. The metallic sheath 14 has at least one vacuum port or opening 16 through which a vacuum source 18 may be applied in order to vacuum atmosphere or air out from within the metallic sheath 14. The opening 16 can also be used for bleeding inert gas through the metallic sheath or later quenching the workpiece, as later described herein. However, other ports can be added or utilized for these steps without departing from the scope of the technology describe herein. The metallic sheath 14, once vacuumed, can be sealed by welding or other such methods.

In some embodiments, the workpiece 12 may be made of high-performance aerospace sheet metal, refractory alloys, or other sheet metal to be formed into the final, complex-shaped part. For example, the workpiece 12 can include cobalt base alloys, nickel base alloys, specialty heat resistant and corrosion resistant steels, Maraging steels, ultrahigh strength steels, titanium alloys, extreme temperature refractory alloys such as niobium, tungsten, molybdenum, hafnium, or rhenium base alloy sheets and/or reactive alloys which cannot be otherwise made into a complex structure at ambient temperature or outside of a vacuum chamber.

The metallic sheath 14 may be made of low-cost oxidation resistant allows and/or sacrificial metal such as sacrificial interface sheets made of mild steels, stainless steel, or nickel base allows. The metallic sheath 14 may be formed to surround extreme temperature refractory alloy sheets or workpieces such as molybdenum, tungsten, and niobium base alloys, which can readily oxidize at forming temperatures, and isolate them from the environment during heating and shaping as described below. Other sacrificial metals can be used without departing from the scope of the invention.

The metallic sheath 14 described herein may be made out of a metal that remains solid while pliable at relatively low pressures. In some embodiments, the metallic sheath 14 may be made of metal with a melting point of at least 2500 degrees F. For example, the metallic sheath 14 may be made from mild steel which may be coated to resist oxidation/scaling on its surfaces exposed to atmosphere when heated. The oxidation/scaling-resistant coatings may include glass coatings such as those used for protection of hard metal alloys for heating and forging. Additionally or alternatively, the metallic sheath 14 may be made from ferritic, austenitic steels, or nickel base alloys. The metallic sheath 14 effectively creates a high temperature-resistant, environmental-resistant vacuum sealed shield over the workpiece.

Figure 1B:
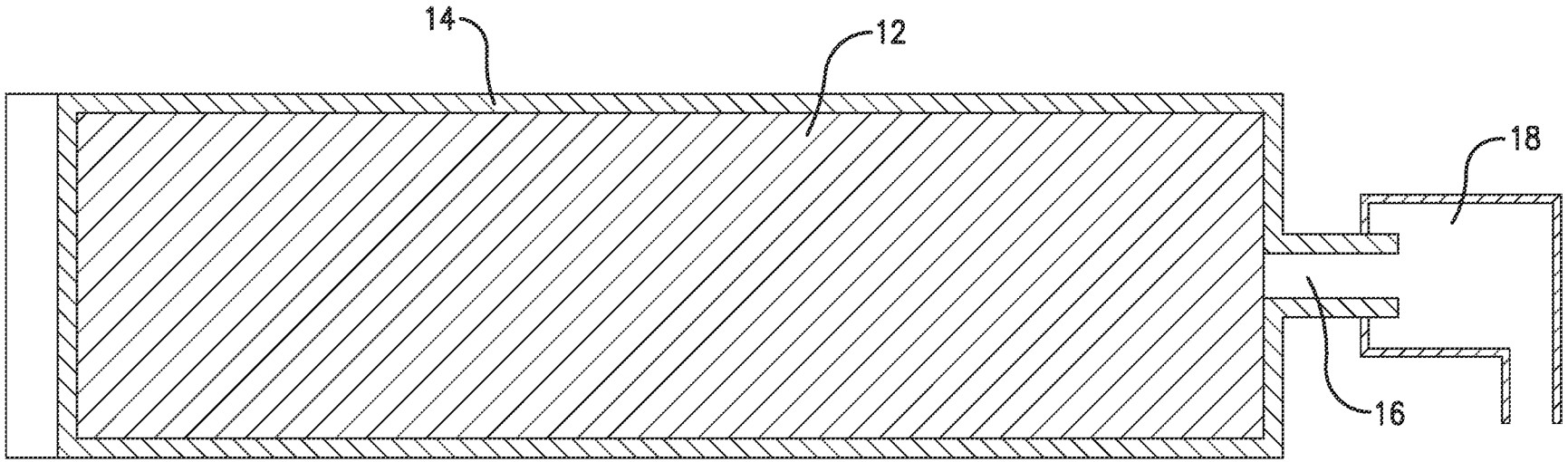

In some embodiments, the metallic sheath 14 can be made by sandwiching the workpiece 12 between two or more separate sheets and sealed via welding or the like around a periphery of the workpiece 12, while still leaving a gap in the seal the at least one vacuum port or opening 16 through which the vacuum source 18 may apply vacuum. However, other ports can be cut into the metallic sheath 14 instead of being located at the welded/sealed seams without departing from the scope of the technology described herein. Alternatively, the metallic sheath 14 can be made of a single sheet of metal folded into two portions between which the workpiece 12 is sandwiched, and a likewise welding can be used around a periphery of the workpiece 12 to seal the workpiece 12 therein after vacuum evacuation of air or atmosphere therefrom, as depicted in FIGS. 1*a*-1*b*.

Figure 2:
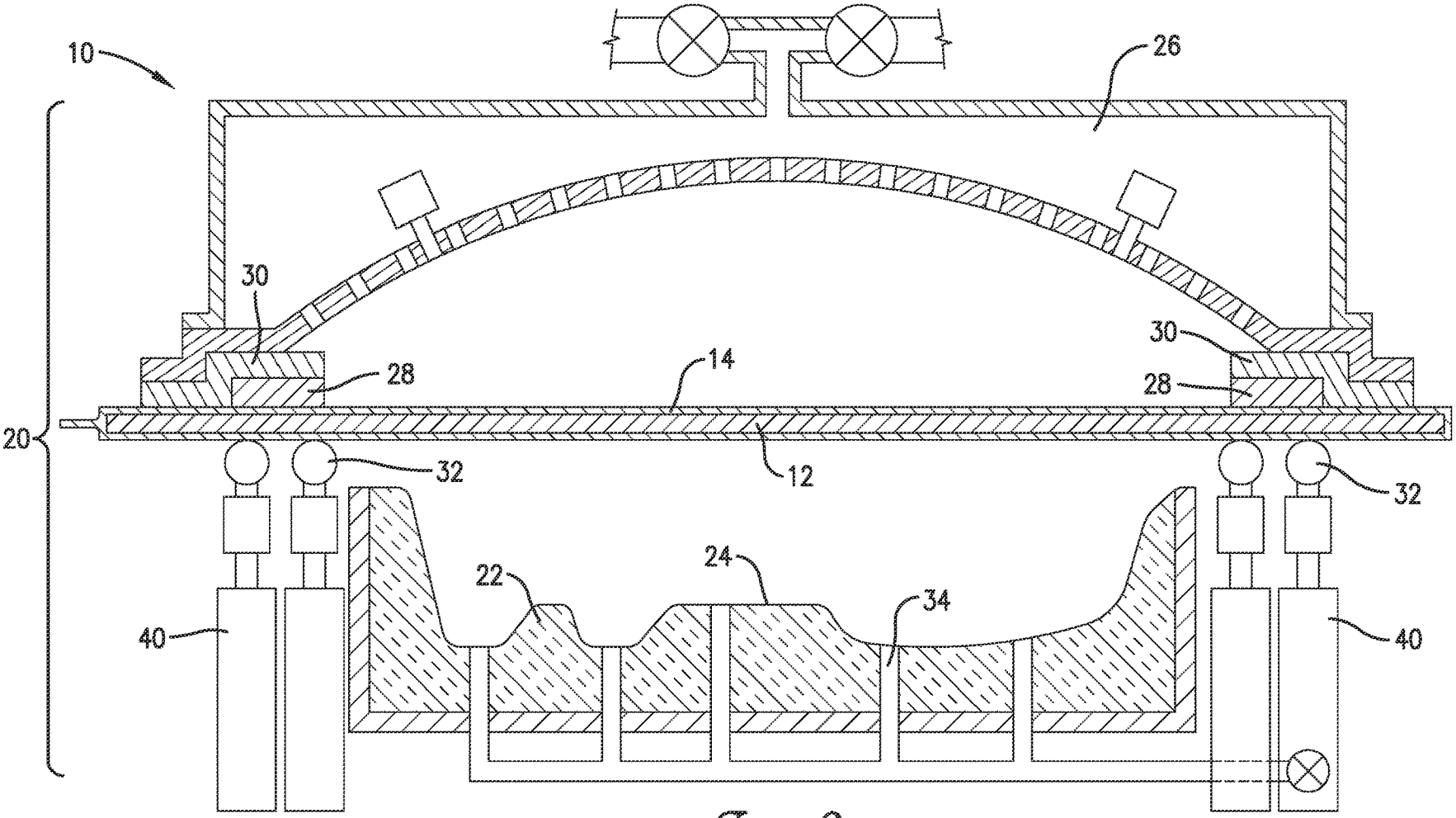
FIG. 2 is a side cross-sectional view of the metal workpiece enclosed within the metallic sheath and located in a system for forming a complex metal part out of the metal workpiece, in accordance with embodiments of the present invention.
Figure 3:
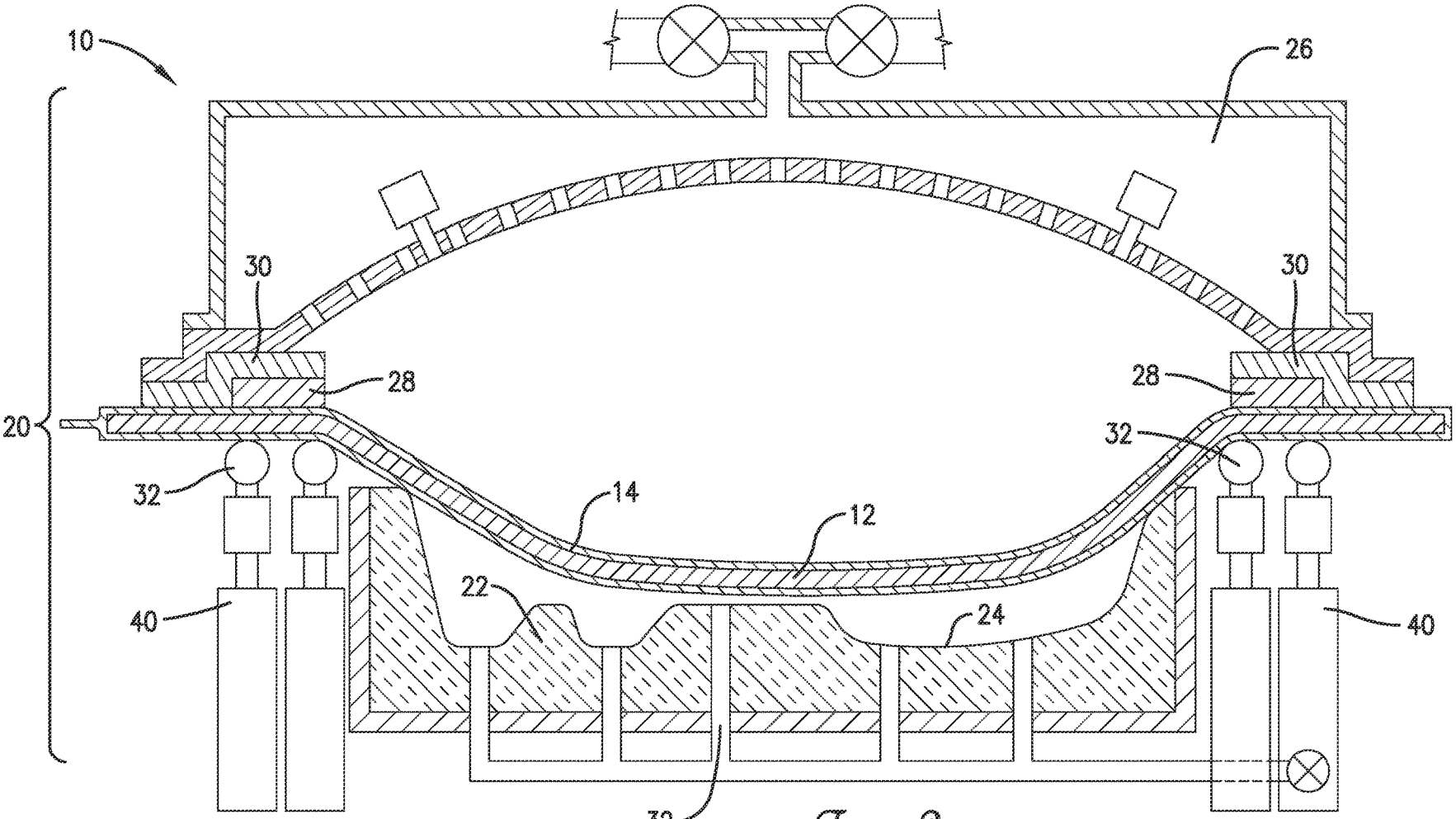
FIG. 3 is a side cross-sectional view of the system of FIG. 2 depicting the metal workpiece and the metallic sheath draping partially toward a ceramic tooling surface while electric current is applied, in accordance with embodiments of the present invention.
Figure 4:
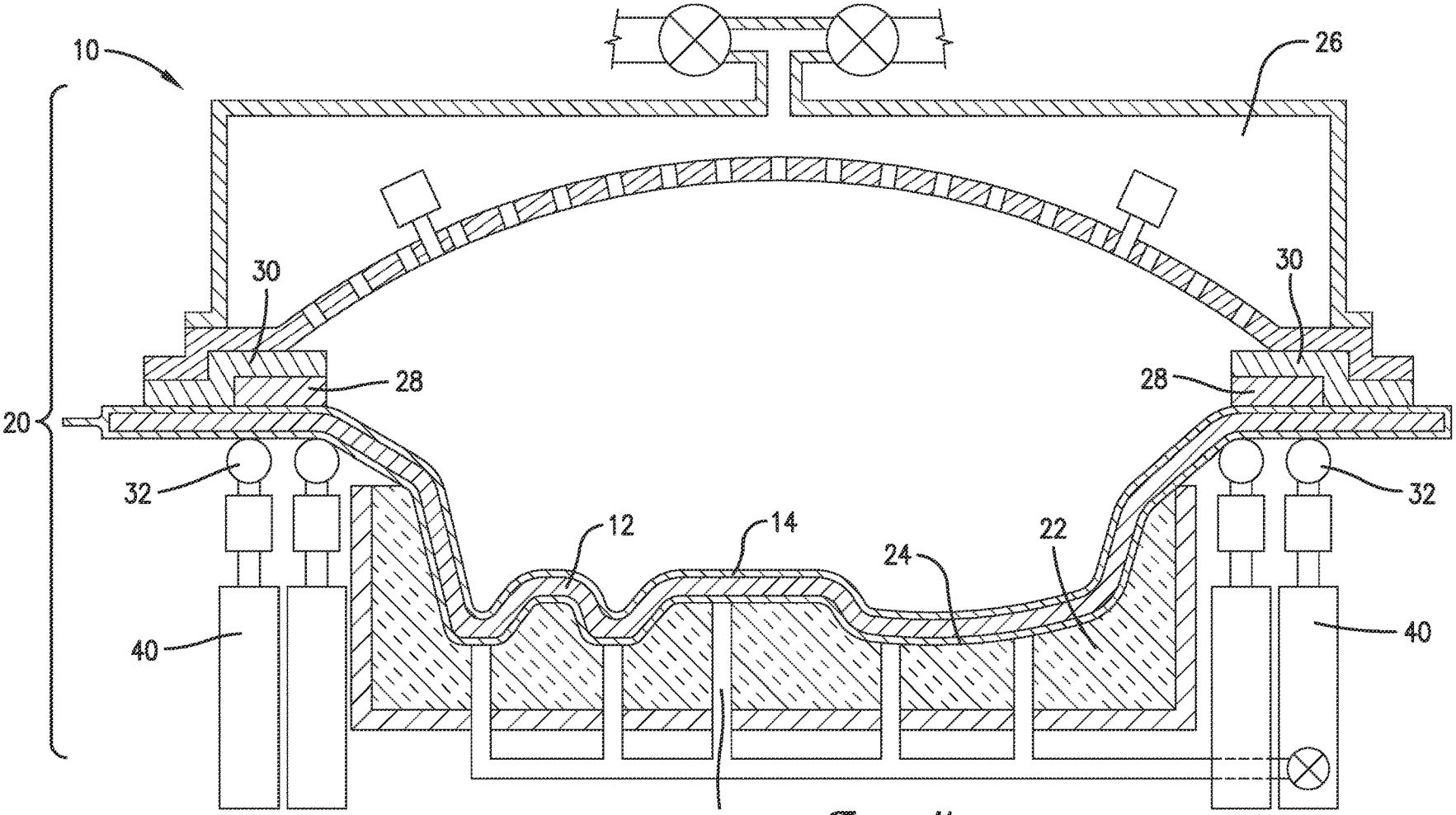
FIG. 4 is a side cross-sectional view of the system of FIG. 2 depicting the metal workpiece and the metallic sheath pressed fully against the ceramic tooling surface, in accordance with embodiments of the present invention.

FIGS. 2-4 depict exemplary tooling for shaping the workpiece 12 while it is sealed within the metallic sheath 14. For example, the tooling 20 can comprise a first ceramic die 22 with a ceramic tooling surface 24, as depicted in FIGS. 2-4, and a pressure die 26 configured for sealing over the workpiece 12 and/or the metallic sheath 14 and pressing both toward the ceramic tooling surface 24. Note that while the first ceramic die 22 is depicted as being located beneath the pressure die 26, these positions can be reversed or otherwise angled or configured without departing from the scope of the technology described herein. The tooling 20 can further include one or more electrical contacts or leads 28 used to provide electric current through the metallic sheath 14 and the workpiece 12 therein for heating thereof. Furthermore, a variety of locations on the tooling 20 can comprise insulation 30, such as a ceramic coating or ceramic paper formed between the electrical leads 28 and the pressure die 26.

Ceramic dies, such as the first ceramic die 22, may have low thermal conductivity and are inherently good thermal insulators. Thus, the metallic sheath 14 and the workpiece 12 therein may be directly heated by passing electricity through them via the leads 28, while the ceramic dies and other ceramic components or insulation describe herein serve as an electrical and thermal insulator, preventing current leakage into the tooling 20. In some embodiments, the first ceramic die 22 and/or other ceramic components described herein may be made from high temperature ceramic material that is electrically insulating (non-conductive), while still transparent to electromagnetic radiation. Examples of ceramic materials for use herein may include silicon dioxide, silicon nitride, aluminum oxide, and/or other electrically insulating ceramics.

The first ceramic die 22 may also comprise workpiece tension control components 32 located at opposing ends of the ceramic tooling surface 24. These workpiece tension control components 32 can be actuatable in opposite directions to enable draping of the metallic sheath 14 and the workpiece 12 vacuum sealed therein toward the ceramic tooling surface 24 while the leads 28 apply electrical current therethrough. As depicted in FIGS. 2-4, the workpiece tension control components 32 may be ceramic rollers biasable against at least one side of the metallic sheath 14 and rotatable toward the ceramic tooling surface 24 (i.e., a first roller actuatable to rotate in a first direction/clockwise and a second roller actuatable to rotate in a second direction/counterclockwise). The rollers may be ceramic or ceramic-coated rollers, balls, or bearings and may be repositionable to increase or decrease the tightness or tension with which they are biased against the metallic sheath 14 and/or the workpiece 12. Any repositioning mechanism 40 can be used for repositioning of the rollers by any desired amount vertically, horizontally, diagonally, or otherwise depending on the shape and tooling used to shape the formed part.

The workpiece tension control components 32 can allow the workpiece 12 and the metallic sheath 14 to be partially released at either end to drape into a cavity of the first ceramic die 22, for example, as depicted in FIG. 3, without requiring as much if any stretching at that stage of the shaping described herein. The subsequent pressing of the workpiece 12 and the metallic sheath 14 against the ceramic tooling surface 24 can then allow for less stretching of the workpiece 12 during shaping thereof than if shaped without the partial release of the workpiece 12 via the ceramic rollers, for example.

Furthermore, some embodiments of the system 10 may include vents 34 or ventilation channels formed through the first ceramic die 22 and through the ceramic tooling surface 24, which may serve as vents to prevent the trapping of air between the metallic sheath 14 and the ceramic tooling surface 24. Additionally or alternatively, the vents 34 may assist in openings for applying a pressure differential to actuate the workpiece 12. For example, the workpiece 12 and the metallic sheath 14 can be pulled toward or pushed away from the ceramic tooling surface 24 via vacuum or forced air. However, such pressure differential can be provided by the pressure die 26 without requiring vacuum via the vents 34 in some embodiments. In some embodiments, one or more of the vents 34 may be used for in-situ solution heat treatment by quenching the workpiece 12 and/or the metallic sheath 14 with inert gas while they remain in the first ceramic die 22 in order to achieve desired mechanical properties with minimal distortion, as later described herein.

Figure 5:
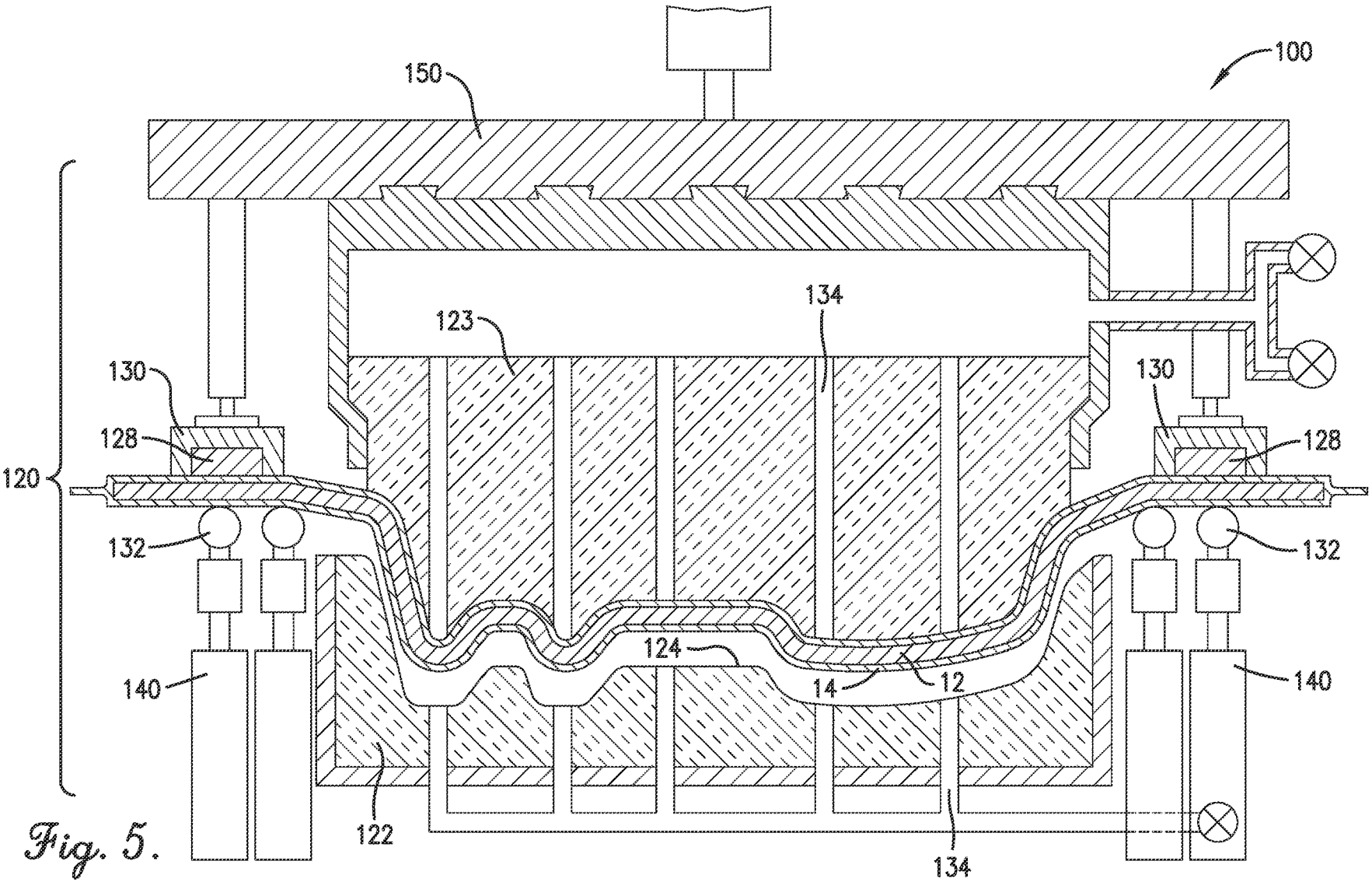
FIG. 5 is a side cross-sectional view of an alternative system for shaping the metal workpiece using two mating dies, in accordance with embodiments of the present invention.

Another embodiment of a system 100 for forming the workpiece 12 and/or the metallic sheath 14 is depicted in FIG. 5 and has similar components to the system 10, including tooling 120 comprising a first ceramic die 122 sharing identical or similar features to the tooling 20 and the first ceramic die 22. However, instead of the pressure die pressure die 26, this configuration may comprise a second ceramic die 123 that is shaped, positioned, and configured to mate with the first ceramic die 122 and/or otherwise form an opposing side of the workpiece 12 than a side formed by the first ceramic die 122. For example, when the workpiece 12 and the metallic sheath 14 are placed between the first and second ceramic dies 122,123, a press 150 may be operated to manually, electromechanically, or pneumatically press the second ceramic die 123 toward the first ceramic die 122. The system 100 can likewise include one or more ceramic tooling surfaces 124, similar to the ceramic tooling surfaces 24 of FIGS. 2-4, as well as electrical contacts or leads 128 and insulation 130, identical or similar to the leads 28 and the insulation 30 described above.

The tooling 120 may also comprise workpiece tension control components 132 similar or identical to the workpiece tension control components 32 described above, and likewise located at opposing ends of the ceramic tooling surface 124. These workpiece tension control components 132 can likewise be actuatable in opposite directions to enable draping of the metallic sheath 14 and the workpiece 12 vacuum sealed therein toward the ceramic tooling surface 124 while the leads 128 apply electrical current therethrough. For example, the workpiece tension control components 132 may be ceramic rollers biasable against at least one side of the metallic sheath 14 and rotatable toward the ceramic tooling surface 124 (i.e., a first roller actuatable to rotate in a first direction/clockwise and a second roller actuatable to rotate in a second direction/counterclockwise). The rollers may likewise be ceramic or ceramic-coated rollers, balls, or bearings and may be repositionable to increase or decrease the tightness or tension with which they are biased against the metallic sheath 14 and/or the workpiece 12. Any repositioning mechanism 140 can be used for repositioning of the rollers by any desired amount vertically, horizontally, diagonally, or otherwise depending on the shape and tooling used to shape the formed part.

The workpiece tension control components 132 can allow the workpiece 12 and the metallic sheath 14 to be partially released at either end to drape into a cavity of the first ceramic die 122, for example, without requiring as much if any stretching initially. The subsequent pressing of the workpiece 12 and the metallic sheath 14 against the ceramic tooling surface 124 via the second ceramic die 123 can then allow for less stretching of the workpiece 12 during shaping thereof than if shaped without the partial release of the workpiece 12 via the ceramic rollers.

Furthermore, some embodiments of the system 100 may include vents 134 or ventilation channels that are similar or identical to the vents 34 described above and formed through the first ceramic die 122 and through the ceramic tooling surface 124, which may likewise serve as vents to prevent the trapping of air between the metallic sheath 14 and the ceramic tooling surface 124. Additionally or alternatively, the vents 134 may assist in openings for applying a pressure differential to actuate the workpiece 12. For example, the workpiece 12 and the metallic sheath 14 can be pulled toward or pushed away from the ceramic tooling surface 124 via vacuum or forced air. Furthermore, the vents 134 may likewise be formed through the second ceramic die 123 and its associated ceramic tooling surface 124 and may similarly prevent air from being trapped between the metallic sheath 14 and the ceramic tooling surface 124. Likewise, the vents 134 formed through the second ceramic die 123 may additionally or alternatively be used to apply pressure differential force or vacuum for moving the workpiece 12 and the metallic sheath 14 toward or away from the second ceramic die 123.

Figure 6:
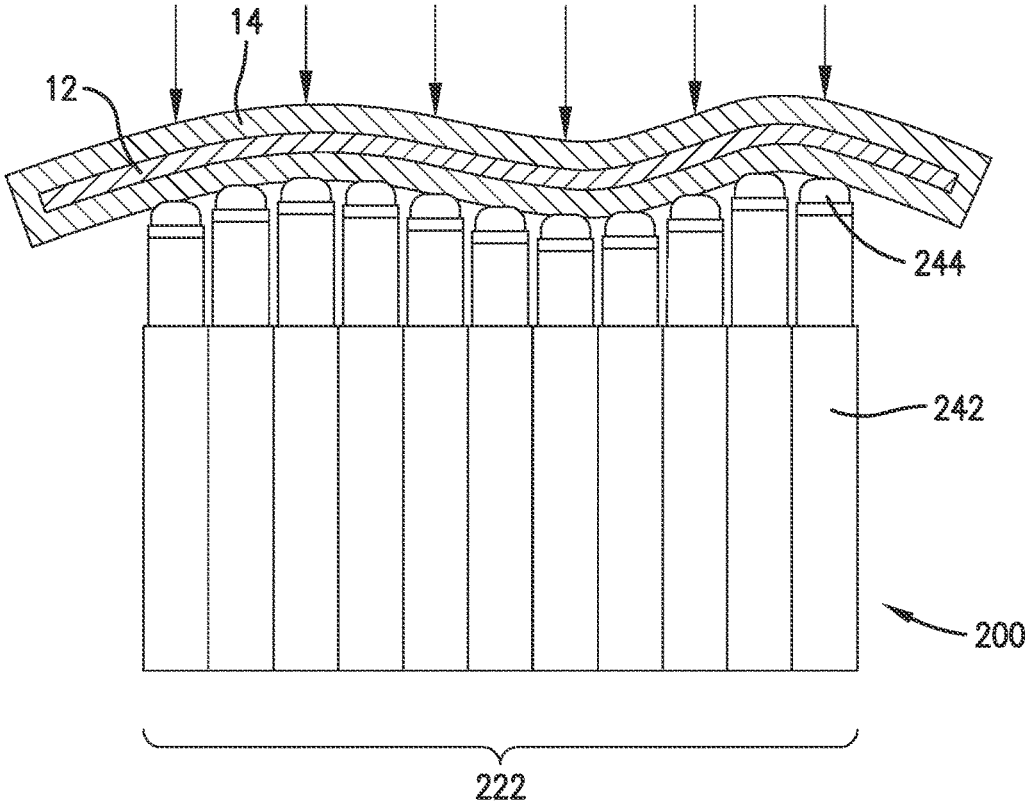
FIG. 6 is a side cross-sectional view of another alternative system for shaping the metal workpiece using a ceramic-coated bed of nails configuration, in accordance with embodiments of the present invention.

In yet another alternative embodiment, a system 200 may have similar or identical components and configurations to the systems 10 and/or 100 described above, but the first ceramic die 22 and/or 122 can be replaced with a fixed or reconfigurable "bed of nails" tooling 222, as depicted in FIG. 6. The bed of nails tooling 222 may comprise a plurality of shafts 242 extending at varying lengths to support the workpiece 12 in a desired curvature or complex-shaped configuration. The plurality of shafts 242 can be made of an insulating material such as ceramic material and/or can have tips 244 thereof covered with insulating material such as ceramic material. Each of the plurality of shafts 242 may be actuatable via automated and/or manual techniques known in the art to reconfigure the bed of nails tooling 222 to a desired part configuration, shape, or curvature.

Figure 7:
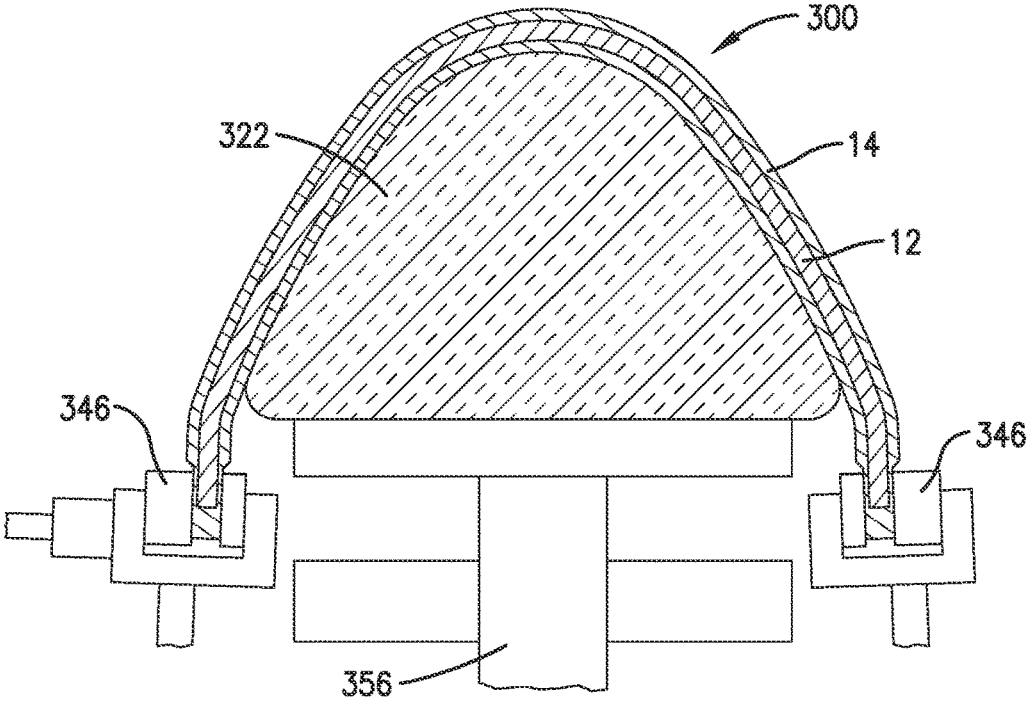
FIG. 7 is a side cross-sectional view of the metallic sheath and the metal workpiece being shaped on an inverted ceramic die via stretch forming, in accordance with embodiments of the present invention.

In some embodiments, as depicted in FIG. 7, a system 300 may have similar or identical components and configurations to the systems 10 and/or 100 described above, but with the first ceramic die 22 or 122 replaced with a first ceramic die 322 over which the workpiece 12 and the metallic sheath 14 are stretched. Specifically, the system 300 may accommodate stretch forming of the workpiece 12 by inverting ceramic tooling so that the ceramic tooling acts like a punch instead of a die, as depicted in FIG. 7. This stretching can be performed via clamps 346 which can be actuated away from the first ceramic die 322 to stretch-form the workpiece 12 while electric current is applied therethrough. Additionally or alternatively, the first ceramic die 322 can be actuatable manually, hydraulically, electromechanically, or the like via one or more actuators 356 to increase the stretching tension applied to the workpiece 12 during forming using the methods later described herein. In some embodiments, the clamps 346 can incorporate the electrical contacts or leads therein without departing from the scope of the technology described herein.

In yet another embodiment, as depicted in FIG. 8, a system 400 may be similar or identical to system 10 as described above, but the rollers depicted for the workpiece tension control components 32 may be replaced with different workpiece tension control components 432 which may comprise translatable frame pieces instead of rollers or the like as described above. However, the system 400 may still comprise a first ceramic die 422, a ceramic tooling surface 424, and a pressure die 426 that are similar or identical to the first ceramic die 22, the ceramic tooling surface 24, and/or the pressure die 26, respectively.

Specifically, the workpiece tension control components 432 in this and any of the other embodiments described herein may be translatable frame pieces fixedly attachable (e.g., via clamps 446 or the like described below) to opposing edge portions of the metallic sheath 14 and configured to be translated laterally toward the ceramic tooling surface 424. These workpiece tension control components can allow the workpiece 12 and the metallic sheath 14 to have opposing end regions moved closer to each other to release tension in the workpiece 12 and allow the workpiece 12 to drape into a cavity of the first ceramic die 422, for example, without requiring as much if any stretching at that stage of the shaping described herein. The subsequent pressing of the workpiece 12 and the metallic sheath 14 against the ceramic tooling surface 424, as depicted in FIG. 8, can then allow for less stretching of the workpiece 12 during shaping thereof due to this pre-stretch draping.

The system 400 may comprise two or more clamps 446 selectively and/or fixedly attaching the metallic sheath 14 and the workpiece 12 therein to the translatable frame pieces. However, these clamps 446 may be used in conjunction with other embodiments where the translatable frame pieces are omitted or are fixed without departing from the scope of the technology herein. That is, the clamps 446 can alternatively serve to merely hold the workpiece 12 and the metallic sheath 14 in place relative to shaping surfaces described herein such as the ceramic tooling surface 24.

In some embodiments, the clamps 446 may comprise a series of independent clamps selectively attachable to the metallic sheath 14 and/or the workpiece 12, as depicted in FIG. 8 or 9*a*. The clamps 446 may have ceramic clamp inserts 460 made of ceramic or the like to electrically isolate the clamps 446 or tooling supporting the clamps 446 from the current applied to the workpiece 12. The clamps 446 can comprise clamp jaws or the like that can be manually, mechanically, electromechanically, hydraulically, or otherwise forced toward each other to clamp onto the workpiece 12 and metallic sheath 14. Furthermore, to apply uniform current, flexible electric contacts or leads 462 in the form of a bundle of flat copper sheets may be used between the ceramic clamp inserts 460 and the metallic sheath 14 in some embodiments, as depicted in FIGS. 9*a* and 9*b*. The flexible electric contact or leads 462 can be used in other embodiments described herein as well, such as any of those depicted in FIGS. 2-7.

In use, any of the systems described above in FIGS. 1*a*-9*b* and/or other equivalents may produce a complex-shaped metal part. Generally, the metallic sheath 14 may be placed around a metal workpiece (e.g., the workpiece 12) and vacuum sealed. The workpiece 12 sealed within the metallic sheath 14 may be heated to forming temperatures via resistance heating by application of electric current through the metallic sheath 14 and the workpiece 12 sealed therein. Gas pressure or another physical force may be applied on one side of the vacuum sealed metallic sheath 14 and may drive or bend the workpiece 12 and the metallic sheath 14 into an intermediate form, such as draped within a cavity of a ceramic die (e.g., the first ceramic die 22). Some rotatable or translatable components allow the heated workpiece 12 and the metallic sheath 14 to be pushed into the intermediate form without significant stretch, such as the workpiece tension control components 32 described above.

Once in the intermediate form, controlled differential pressure may drive the workpiece 12 fully into a ceramic die cavity and/or otherwise fully against the ceramic tooling surface 24 or the like to achieve complex shapes without excessive localized thinning. If needed, the resulting formed part can be pushed up away from the ceramic tooling surface and sprayed with cooling gas from both sides of the metallic sheath/workpiece or otherwise heat treated. In some embodiments, intermittently pushing the workpiece up after it has partially touched the ceramic tooling surface 24 can also help with temperature uniformity as electric current can reheat any area of the workpiece 12 cooled by heat transfer. Once resistance heated for a required length of time at a required temperature, the resulting formed part can be cooled and the metallic sheath 14 can be removed from the resulting formed part.

The flow chart of FIG. 10 depicts the steps of an exemplary method 1000 for manufacturing a simple or complex-shaped metal part or structure in more detail. In some embodiments, various steps may be omitted, or steps may occur out of the order depicted in FIG. 10 without departing from the scope of the technology as described herein. For example, two blocks shown in succession in FIG. 10 may in fact be executed substantially concurrently, or blocks may sometimes be executed in the reverse order depending upon the functionality involved.

In some embodiments, the method 1000 may include a step of placing the workpiece 12 within the metallic sheath 14 as depicted in block 1002 and FIGS. 1*a*-1*b*. The metallic sheath 14 may be formed, for example, by sandwiching the workpiece between two ductile, oxidation-resistant metallic sheets or plates welded together to form a cavity. The metallic sheets or plates used to form the metallic sheath may each be, for example, a foil gauge down to 0.010 inch or the like. In some alternative embodiments, a single metallic sheet or plate may be folded, and the workpiece may be placed between two resulting portions of the single metallic sheet forming the metallic sheath 14, as described above.

The thickness of the sheet(s) or plate(s) used to form the metallic sheath 14 may additionally be optimized to further insulate the workpiece 12 from direct contact with the ceramic tooling 20 or ceramic tooling surface 24 and the like described above to protect the workpiece's surfaces from surface irregularities of the tooling 20 used for shaping of the workpiece 12. For example, dimpling or other such surface imperfections can impact the metallic sheath 14 but not the workpiece 12 if the thickness of the metallic sheath 14 is sufficient for such protection, particularly for embodiments where the ceramic tooling surface is formed by re-configurable dies (e.g., a bed of nails tooling configuration as described herein and depicted in FIG. 6). The metallic sheath 14 can also protect the workpiece's surfaces from damage in case of presence of loose ceramic particles on the ceramic die surface 24, for example.

For embodiments where the metallic sheath 14 is made of mild steel, the outer surfaces of the metallic sheath 14 may be coated with, for example, glass coating to prevent scaling and/or excessive oxidation. Inner surfaces of the metallic sheath 14 may remain uncoated in some embodiments. In other embodiments, prior to placing the workpiece into the metallic sheath 14, some embodiments may include coating inside surfaces of the metallic sheath 14 with a release agent (not shown) or ceramic coating to prevent bonding of the workpiece 12 to the metallic sheath 14. The release agents or coating may be typical coatings made of boron nitride, aluminum oxide, silicon dioxide, titanium oxide, yttrium oxide, zircon, partially stabilized zirconium oxide, and/or, ceramic paper (e.g., felt) for example. Alternatively, the metallic sheath 14 may be a stainless sheet or nickel alloy sheath that is pre-oxidized to prevent diffusion bonding to the workpiece 12. In other embodiments, placing the workpiece 12 within the metallic sheath 14 may additionally or alternatively involve using a sacrificial foil or ceramic paper (e.g., felt) between the metallic sheath 14 and the workpiece 12 to stop diffusion bonding of the workpiece 12 to the metallic sheath 14. Preventing of this diffusion bonding can assist in post-forming removal of the resulting formed part from within the metallic sheath 14.

The step of enclosing the workpiece 12 within the metallic sheath 14 may also include, in some embodiments, welding the two metallic sheets or plates together. "Welding," as used herein, may refer to resistances welding or any other types of welding known in the art for sealing peripheral portions of the two metallic sheets or plates together. The welding may be performed all around peripheral edges or edge portions of the plates or sheets except for at the opening 16 (e.g., an inlet, outlet, or port), as depicted in FIGS. 1*a*-1*b*, thus creating a welded chamber (i.e., the metallic sheath 18) out of the plates with an open port for a subsequent evacuation or vacuum step. However, note that the workpiece 12 may be placed into any metallic sheath having at least one open port using other techniques without departing from the scope of the technology herein.

The method 1000 may also include evacuating air or atmosphere via the opening 16 from within the resulting metallic sheath 14 (e.g., via vacuum or other such evacuation methods), as depicted in block 1004. Along with the air or atmosphere evacuated therefrom, water vapor and or other contaminants may also be removed during this step. The method 1000 may further include a step of sealing (e.g., welding) the opening 16 of the metallic sheath 14 shut immediately following evacuation and/or while evacuation is still in process, as depicted in block 1006, in order to create a ductile vacuum sealed enclosure. The workpiece 12 fully sealed/welded within the metallic sheath 14 is depicted in FIGS. 1*a*-1*b*.

Note that, in some embodiments, the vacuuming and sealing steps may further comprise or be proceeded by an optional purge of the metallic sheath 14 with an inert gas to reduce air content therein and to help reduce moisture and oxygen concentrations to a very low level. For example, argon or inert gas may be bled through the space within the chamber created within the metallic sheath 14 while vacuum is being applied. Furthermore, in some embodiments, inert gas may be used to deliver controlled levels of dry Ammonium Fluoroborate within the metallic sheath 14. Additionally or alternatively, before sealing the vacuum sealed metallic sheath 14, ammonium flu-borate may act as an in-situ de-oxidation agent during heat exposure.

The method 1000 may further include a step of heating the metallic sheath 14 with the workpiece 12 therein by applying electrical current to both the metallic sheath 14 and the workpiece 12, as depicted in block 1008 and FIGS. 2-5 and 7-8. For example, the electric current (e.g., using high-amperage, low voltage power supply) applied to the metallic sheath 14 and the workpiece therein may be sufficient to heat the workpiece to above 1,200 degrees F. in some embodiments, while still remaining below a melting point of the metallic sheath 18. However other temperature ranges may be used without departing from the scope of the technology described herein and may depend on what alloy the workpiece is made of. For example, the workpiece can be heated and formed at temperatures slightly below (e.g., 25 degrees F.-75 degrees F. below) the precipitation hardening temperature for the workpiece, such that the resulting formed part may no longer require re-heat treatment in some embodiments.

Direct heating of the workpiece only may be significantly faster and more energy efficient than heating the tooling 20 (e.g., die) and/or a furnace surrounding the tooling in addition to the workpiece/part to be formed. Controlled application of electric current before and/or during shaping of the workpiece 12 and as the metal sheath 14 touches the die or ceramic tooling surface 24 ensures the workpiece 12 maintains proper temperature throughout the shaping/forming process. The electric current can be applied to the metallic sheath 14 and the workpiece 12 directly via Joule heating or indirectly via induction heating. Additionally or alternatively, the electric current can be a controlled, pulsed current that is pulsed at particular frequencies and may be used to allow formation at lower temperatures (e.g., particularly where the workpiece is a superalloy or a titanium alloy like the 6242 titanium alloy). In some embodiments, temperature of the electrically heated workpiece 12 and/or the metallic sheath 14 surrounding the workpiece 12 may be continuously monitored and current may be adjusted accordingly to heat the workpiece 12 uniformly to a desired temperature range for forming and heat treatment of the workpiece into a final formed part.

The method 1000 may also include a step of shaping the metallic sheath 14 and the workpiece 12 therein, as depicted in block 1010. Shaping of the workpiece into the formed part can be accomplished by applying various forming stresses applied during the heating being applied via electric current, as described above. Forming stresses may be applied by using differential pressure, match dies, or stretch forming equipment, for example, such as those depicted in FIGS. 2-8. Such techniques can be used for pressing and/or stretching the workpiece 12 into a desired shape of a final complex-shaped metal part. In some embodiments, ceramic tooling such as ceramic dies described above, can be used for shaping the vacuum sealed metallic sheath 14 and the workpiece 12 therein during hot forming of the metallic sheath 14 and workpiece 12. The ceramic die, ceramic dies, or other ceramic tooling described herein may be used as electric insulators to enable simultaneous application of electric current during forming.

In some alternative embodiments, the shaping step may also include reconfiguring ceramic dies for different shapes or curvatures, resulting in formed parts having different shapes or curvatures. As described above, this reconfiguring can be done manually or automatically by actuating portions of ceramic tooling described herein and/or by trading out selectable ceramic pieces of various shapes and curvatures to piece together a new complex-shaped surface for shaping the formed part. Specifically, the ceramic dies or tooling 20 described herein may be made from reconfigurable tooling of other materials with ceramic inserts, insulation, and/or coating placed therein or thereon for mating with the metallic sheath 14 during shaping or forming of the workpiece 12. Thus, while other non-insulating materials can be used in the tooling 20 for shaping of the formed part, the ceramic inserts, insulation, or coating may insulate the metallic sheath 14 and/or the workpiece 12 from any conductive portions of such tooling 20. In one alternative embodiment, ceramic tooling may include a "bed of nails" made of ceramic or insulated by ceramic tips, as depicted in FIG. 6 and described above. Ceramic insulation may likewise be used to electrically isolate electrical clamps, as depicted in FIGS. 7*a* and 7*b*, as well as other forming equipment supporting the ceramic tooling from current leakage.

Direct heating of the workpiece 12 and its vacuum sealed metallic sheath 14 by application of electricity advantageously may not require heating of the ceramic tooling or dies described herein in some embodiments. Furthermore, the energized metallic sheath 14 thermally insulates the workpiece from initial contact with the ceramic tooling (e.g., the ceramic dies). Specifically, in some embodiments, the heating and shaping steps above may further comprise intermittent raising/lifting of the metallic sheath 14 with the workpiece 12 therein from the ceramic tooling surface 24 (or other ceramic forming surfaces described herein) while the workpiece 12 is still energized, which may help equilibrate temperature. For example, the methods described herein may also include raising the metallic sheath 14 and the workpiece 12 therein away from the ceramic tooling surface 24 or 124 to ensure temperature uniformity is maintained during heating and/or shaping of the workpiece 12. This may be particularly helpful when the workpiece 12 (or the metallic sheath 14 surrounding the workpiece) partially contacts the ceramic tooling surface 24 or 124 as the entirety of electric current is passed through the workpiece 12 and thus the ceramic tooling surface 24 or 124 is essentially heated indirectly via conduction, convection, and radiation heat transfer from the workpiece 12 and/or the metallic sheath 14.

This raising and lowering can be accomplished via pressure differential applied as described herein and/or by raising or lowering various clamps or the like to which the metallic sheath 14 and/or the workpiece 12 are attached. The ability to intermittently raise the workpiece 12 and metallic sheath 14 off the ceramic tooling surface 24 or 124 during forming also may allow draping of or pushing the heated metallic sheath 14 and workpiece 12 partly into a die or tooling cavity without stretching the workpiece 12. Furthermore, raising the workpiece 12 and the metallic sheath 14 surrounding it slightly off the dies or ceramic tooling, immediately shutting off the power or current flowing through the workpiece 12 when correct solution heat treatment or hardening temperature has been achieved, and quenching with inert gas (e.g., liquid nitrogen or argon) the workpiece 12 may also be used in some embodiments to achieve a pre-requisite condition for aging or tempering to desired mechanical properties. This may also be referred to as in-situ solution heat treating. As noted above, such inert gas can be introduced via the vents 34, for example.

Sacrificial sheets such as the metallic sheath 14 described herein to protect the workpiece 12 can also be useful during the shaping step as an interpolator or as a diaphragm to assist forming the workpiece 12, to protect the workpiece 12 from surface damage or surface irregularities, and/or to help avoid tearing, buckling, or wrinkling of the workpiece 12 during heating and shaping thereof. In one embodiment, the workpiece 12 may be heated above 1,200 degrees F. very rapidly over reconfigurable tooling as described herein, and the metallic sheath 14 can act as a diaphragm/interpolator, protecting surfaces of the workpiece 12 from dimpling when formed over a bed of nails configuration as described above and depicted in FIG. 6, for example. That is, in some embodiments, the metallic sheath 14 may have a thickness sufficient to work similar to how a rubber diaphragm works for forming parts at room temperature or warm forming over reconfigurable tooling such as the bed of nails tooling.

In some embodiments, the shaping step described above may comprise displacement followed by workpiece deformation. Specifically, the shaping step may further include controlled stretching techniques applied to the workpiece 12 and/or any combination of wrapping or pre-stretch drawing of the workpiece 12 into the die or mold cavities depicted herein. For example, ceramic or ceramic-coated rollers, balls, or bearings, as depicted in FIGS. 2-4 may facilitate movement of the workpiece 12 (or feeding thereof) at least partially into the tooling 20 or ceramic die cavity (i.e., workplace displacement) without stretching the workpiece 12, thus minimizing localized thinning of the workpiece 12 during hot forming. This way the final shape is achieved in two or more stages, with first the workpiece 12 flowing or draping into the tooling 20 or die cavity with minimum or stretching, and final settling of the workpiece 12 against the ceramic tooling surface 24 or 124, which may result in less localized thinning than forming by stretching the workpiece 12 throughout the entirety of the shaping/forming operation.

As described above and depicted in FIGS. 2-5 and 8, actively controlled reconfigurable tooling can further draw and/or drape deeper into the ceramic die cavity before the next forming operation (e.g., compression against the ceramic tooling surface 24 or 124) to minimize thinning of the workpiece 12. For example, the rollers, balls, or bearings depicted in FIGS. 2-4 may be configured to allow passage of the workpiece therebetween and into a cavity of the tooling 20 or the first ceramic die 22 via weight of the workpiece 12 and gravity and/or vacuum force via the vents 34 or otherwise. Furthermore, the reconfigurable tooling and/or the rollers, balls, or bearings may be automated and/or manually actuated to feed a portion of the workpiece inward, such that it drapes into the cavity of the first ceramic die 22. However, as depicted in FIGS. 5 and 8, instead of the rollers, other translatable frame pieces 452 can be attached via opposing end or edge clamps (e.g., the clamps 446) affixed to the translatable frame pieces 452. The translatable frame pieces 452 can be actuated toward each other as the workpiece 12 is drawn into a die cavity or tooling, as described above.

Additionally or alternatively, this pre-stretch drawing of the workpiece 12 may further comprise applying gas pressure or differential pressure between a top and bottom die (e.g., between the first ceramic die 22 and the pressure die 26 or between the first ceramic die 122 and the second ceramic die 123), forcing the workpiece 12 and the metallic sheath 14 to slide into a cavity of the tooling 20 or a cavity of one of the dies with minimum or no stretch. For example, as depicted in FIGS. 2-5 and described above, the first ceramic die 22 or 122 and/or the second ceramic die 123 can have one or more ports or vents 34 or 134 formed therethrough to a forming surface of the tooling or dies, serving as vents to prevent the trapping of air between the metallic sheath 14 and the ceramic tooling surfaces 24 or 124 and/or to additionally assist in creating a pressure differential. For example, vacuum through the vents 34 can pull the workpiece 12 and the metallic sheath 14 toward the ceramic tooling surface 24, as in FIGS. 2-4. In other embodiments, pressure can be forced through the vents 134 on one side and vacuum can be applied on another side of the metallic sheath 14 to assist in drawing the workpiece 12 and the metallic sheath 14 around the workpiece 12 into a cavity of the tooling or first ceramic die 122, as depicted in FIG. 5. Compensating for the tendency of the workpiece 12 to stretch using the techniques described herein can also compensate for the tendency of the workpiece 12 to wrinkle along a concave surface thereof during forming, for example.

In some embodiments, the shaping step herein may also include adjusting of the clamps 446 or the like such that the clamps 446 attached to the metallic sheath 14 and/or the workpiece 12 are properly conformed to the configuration of the tooling or ceramic tooling surfaces. The clamps likewise can be actuated during the shaping step in some configurations described herein to move towards or away from the die, thereby applying controlled tension or alternatively facilitating the movement of the workpiece 12 and the metallic sheath 14 into the tooling or one of the die cavities herein with minimum stretching, and also to apply controlled tension to stretch the workpiece 12 when and where needed during final stages of the shaping/forming operations. These and other such alternative methods may provide a controlled degree of tension applied at opposing ends or edge areas of the metallic sheath 14 while it is being heated and shaped and may help balance bending and stretching to optimize forming for certain shapes.

Following heating and shaping steps, the method 1000 may comprise a step of cooling the metallic sheath 14 and the workpiece therein 12, as depicted in block 1012, then removing the metallic sheath 14 and the workpiece therein 12 from the tooling 20 or other ceramic tooling described herein, as depicted in block 1014. This cooling can be performed by removing the electric current, turning the electric current off, and/or by applying cooling inert gas or alternative cooling techniques known in the art. Following removal of the metallic sheath 14 and the workpiece therein 12, the method may include removing the metallic sheath 14 from the workpiece 12 (which is now the formed part in its simple or complex shape), as depicted in block 1016. Specifically, welded (or otherwise sealed) edges of the metallic sheath 14 may be cut off and the two plates or metallic sheets may be removed from the workpiece 12 or resulting formed part. Specifically, some embodiments of the method 1000 may include cutting open the metallic sheath 14 and removing the metallic sheath 14 from the formed part (or alternatively removing the formed part from the metallic sheath 14). Then the resulting formed part may be trimmed, punctured, drilled, or machined in any way desired for finishing the shaped final part. The method 1000 thus produces complex shapes from hard metal sheets to net or very near-net in very few steps followed by trimming and drilling to the formed part detailed configuration and may generally replace hot forming and SPF (super plastic forming) for manufacturing of a hard metal part made of one or more of the metal alloys described herein.

In some embodiments, following formation of the formed part as described above, the formed part may be subsequently inspected using non-destructive methods. Such non-destructive methods may include, for example, ultrasonic inspection, radiographic methods including real-time and computed tomography, thermographic inspection, and various other techniques with process parameters optimized to ensure full compliance with quality requirements for a given finished part.

The tooling and methods described herein may also allow in-situ heat treating while the workpiece 12 is still inside the forming die or ceramic tooling. In some embodiments, using principles of electro-plasticity may allow forming of the workpiece 12 below aging temperature and/or below the precipitation hardening temperature of various alloys, which may allow avoiding re-heat treatment of the workpiece 12 or the formed part. Specifically, the principles of electro-plasticity may be used in accordance with the methods herein to eliminate work hardening and reduce flow stresses, thus reducing the steps required to produce the complex-shaped metal part. In addition to eliminating the requirement for re-heat treatment, use of electro-plasticity principles as described herein may also reduce or eliminate risks with distortion and the need for additional testing for certification of heat treatment (which adds cost and complexity to the manufacturing process).

So, although avoiding re-heat treatment in many applications described herein may be desirable and may be achievable with certain materials and steps described herein, there may alternatively be certain circumstances in which solution treatment and rapid quenching is still desired due to resulting improvements in mechanical properties. Thus, in such circumstances, the workpiece 12 or the formed part described herein may also be in-situ solution heat treated or hardened while the workpiece 12 is still in the tooling or ceramic die using the raising and lowering techniques described above in order to achieve desired mechanical properties with minimal distortion. Furthermore, in some embodiments, once minimum time at temperature is reached, argon, nitrogen gas, or argon helium mixture can be sprayed from one or both sides of the workpiece via the vents 34 or 134 for uniform cooling and/or rapid quenching. In some heat treatment techniques following formation thereof, inert gas can be applied to the workpiece via one or more ports or openings formed into the metallic sheath 14, which may be the same or different openings than those used to vacuum atmosphere out from within the metallic sheath. Likewise, the same lines used for vacuum or pressure can be used to spray the inert gas or inert quench medium to rapidly cool the formed part.

Although the invention has been described with reference to the preferred embodiment illustrated in the attached drawing figures, it is noted that equivalents may be employed and substitutions made herein without departing from the scope of the invention as recited in the claims of a subsequent regular utility patent. Specifically, components described for the various exemplary systems described above and depicted in FIGS. **2-9*b* can be interchanged and combined with components of any of the other embodiments without departing from the scope of the technology as described herein. For example, the flexible copper leads 462 can be used in place of any of the electrical leads described herein, such as those depicted in FIGS. 2-7**.

Having thus described one or more embodiments of the invention, what is claimed as new and desired to be protected by Letters Patent includes the following:

1. A method of manufacturing a complex-shaped metal part, the method comprising:

applying a metallic sheath around a workpiece, wherein the workpiece is metal, wherein said applying the metallic sheath comprises enclosing the workpiece in the metallic sheath, evacuating atmosphere from within the metallic sheath, and sealing the metallic sheath so that the metallic sheath forms a sealed, evacuated metallic envelope conforming to the workpiece;

applying an electric current to the metallic envelope to convey the electric current from the metallic envelope through the workpiece in the metallic envelope to heat the workpiece;

shaping the workpiece in the metallic envelope into a complex-shaped metal part; and cooling the complex-shaped metal part.

2. The method of claim 1, further comprising removing the metallic sheath from the complex-shaped metal part.

3. The method of claim 1, wherein the workpiece is made of sheet metal including cobalt base alloys, nickel base alloys, heat resistant and corrosion resistant steels, Maraging steels, ultrahigh strength steels, titanium alloys, extreme temperature refractory alloys, or reactive alloys.

4. The method of claim 1, wherein shaping the workpiece in the metallic envelope comprises pressing the workpiece in the metallic envelope against a ceramic tooling surface.

5. The method of claim 4, wherein the ceramic tooling surface comprises inward- facing surfaces of two mating ceramic dies.

6. The method of claim 4, wherein the ceramic tooling surface is a ceramic die surface within a pressure chamber.

7. The method of claim 1, wherein shaping comprises at least partially drawing the metallic envelope through ceramic rollers, biased against at least one side of the metallic envelope and located at opposing edge regions of the metallic envelope, toward a ceramic tooling surface and then fully compressing the metallic sheath with the workpiece therein against the ceramic tooling surface while electric current is applied through the workpiece.

8. The method of claim 1, wherein opposing edge portions of the metallic envelope are attached to translatable frame pieces, wherein shaping further comprises the translatable frame pieces translating toward each other as the metallic envelope with the workpiece therein is drawn into a ceramic cavity while the electric current is applied.

9. The method of claim 4, wherein the ceramic tooling surface is made of a plurality of reconfigurable shafts actuatable to extend by varying amounts to cooperatively form different shaped surfaces for the ceramic tooling surface.

10. The method of claim 4, further comprising heat treating the complex-shaped metal part, wherein heat treating is performed while the workpiece is pressed against the ceramic tooling surface.

11. A method of a complex-shaped metal part, the method comprising:

enclosing a worksheet within a metallic sheath, wherein the workpiece is sheet metal made of at least one of a refractory alloy and a reactive alloy, wherein the metallic sheath is sacrificial metal;

evacuating atmosphere through an opening of the metallic sheath via vacuum;

sealing the opening of the metallic sheath following the evacuating step, wherein after the enclosing, evacuating, and sealing steps, the metallic sheath fully encases the worksheet and vacuum pressure in the metallic sheath draws the metallic sheath into close conformity with all sides of the worksheet;

applying an electric current through the workpiece in the metallic sheath to heat the workpiece;

shaping the workpiece in the metallic sheath into a complex-shaped metal part, including pressing the workpiece in the metallic sheath against at least one ceramic tooling surface; and cooling the complex-shaped metal part wherein the metallic sheath fully encases the worksheet and vacuum pressure in the metallic sheath draws the metallic sheath into close conformity with all sides of the worksheet before said shaping.

12. The method of claim 11, wherein the sheet metal includes one or more of cobalt base alloys, nickel base alloys, heat resistant and corrosion resistant steels, Maraging steels, ultrahigh strength steels, titanium alloys, and extreme temperature refractory alloys.

13. The method of claim 11, further comprising cutting open and removing the metallic sheath from the complex-shaped metal part after cooling.

14. The method of claim 11, wherein shaping the workpiece in the metallic sheath comprises pressing the workpiece in the metallic sheath between two or more ceramic dies.

15. The method of claim 11, wherein a sacrificial foil or sheet is placed between the metallic sheath and the workpiece or wherein inside surfaces of the metallic sheath are coated with a release agent or pre-oxidized to prevent bonding of the workpiece to the metallic sheath.

16. The method of claim 11, wherein said sealing the opening comprises welding the opening shut.

* * * * *